US010718547B2

(12) United States Patent
Baba

(10) Patent No.: US 10,718,547 B2
(45) Date of Patent: Jul. 21, 2020

(54) AIR-CONDITIONING APPARATUS HAVING A DRAIN SENSOR AND ASSOCIATED COMPRESSOR CONTROL

(71) Applicant: Mitsubishi Electric Corporation, Tokyo (JP)

(72) Inventor: Yohei Baba, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 48 days.

(21) Appl. No.: 16/093,473

(22) PCT Filed: May 31, 2016

(86) PCT No.: PCT/JP2016/066025

§ 371 (c)(1),
(2) Date: Oct. 12, 2018

(87) PCT Pub. No.: WO2017/208342

PCT Pub. Date: Dec. 7, 2017

(65) Prior Publication Data

US 2019/0383516 A1 Dec. 19, 2019

(51) Int. Cl.
*F24F 13/22* (2006.01)
*F24F 11/86* (2018.01)
(Continued)

(52) U.S. Cl.
CPC ..... *F24F 13/22* (2013.01); *F24F 1/0003* (2013.01); *F24F 11/61* (2018.01); *F24F 11/86* (2018.01);
(Continued)

(58) Field of Classification Search
CPC ..... F24F 1/0003; F24F 11/61; F24F 11/86; F24F 2140/12; F24F 2140/20;
(Continued)

(56) References Cited

U.S. PATENT DOCUMENTS 5,347,826 A * 9/1994 Hayashida ..... F24F 3/065 62/117
5,611,209 A 3/1997 Ogasawara et al.
(Continued)

FOREIGN PATENT DOCUMENTS

JP S59-103128 U 7/1984
JP H01-279741 A 11/1989
(Continued)

OTHER PUBLICATIONS

International Search Report of the International Searching Authority dated Aug. 30, 2016 for the corresponding International application No. PCT/JP2016/066025 (and English translation).

*Primary Examiner* — Jonathan Bradford
(74) *Attorney, Agent, or Firm* — Posz Law Group, PLC

(57) ABSTRACT

An air-conditioning apparatus according to the present invention includes: a heat-source-side unit including a heat-source-side heat exchanger and a compressor; a plurality of load-side units including respective load-side heat exchangers and respective load-side expansion devices; and a relay unit connected between the heat-source-side unit and the plurality of load-side units by a first gas pipe and a first liquid pipe. The relay unit includes a gas/liquid separator which separates refrigerant supplied from the heat-source-side unit into gas refrigerant and liquid refrigerant, a gas-refrigerant supply pipe and a liquid-refrigerant supply pipe which are connected to the gas/liquid separator and each of the plurality of load-side units, a drain pan which is provided in a housing of the relay unit and which receives dew-condensation water, and a heat transfer body which is provided in the drain pan and which is in contact with the liquid-refrigerant supply pipe.

5 Claims, 7 Drawing Sheets

(51) Int. Cl.

| | |
|---|---|
| ***F24F 11/61*** | (2018.01) |
| ***F24F 1/0003*** | (2019.01) |
| ***F25B 41/04*** | (2006.01) |
| ***F25B 49/02*** | (2006.01) |
| *F24F 140/12* | (2018.01) |
| *F24F 140/20* | (2018.01) |

(52) U.S. Cl.
CPC ..... *F25B 41/04* (2013.01); *F25B 49/02* (2013.01); *F24F 2013/225* (2013.01); *F24F 2140/12* (2018.01); *F24F 2140/20* (2018.01); *F25B 2313/0231* (2013.01); *F25B 2313/0233* (2013.01); *F25B 2313/0314* (2013.01); *F25B 2400/13* (2013.01); *F25B 2400/23* (2013.01); *F25B 2600/23* (2013.01); *F25B 2700/1931* (2013.01); *F25B 2700/1933* (2013.01); *F25B 2700/2103* (2013.01)

(58) Field of Classification Search
CPC .. F25B 41/04; F25B 49/02; F25B 2313/0231; F25B 2313/0233; F25B 2400/13; F25B 2400/23; F25B 2600/23; F25B 2700/1931; F25B 2700/1933; F25B 2700/2103
See application file for complete search history.

(56) References Cited

U.S. PATENT DOCUMENTS

| | | | | |
|---|---|---|---|---|
| 7,854,141 | B1 * | 12/2010 | Breen | F24F 1/022 62/272 |
| 9,038,705 | B2 * | 5/2015 | Itamura | B22D 17/007 164/113 |
| 2002/0000093 | A1 * | 1/2002 | Lea | F24F 13/222 62/150 |
| 2005/0217299 | A1 * | 10/2005 | Chu | F24F 13/222 62/259.2 |
| 2012/0031130 | A1 * | 2/2012 | Morimoto | F16K 27/003 62/196.1 |
| 2012/0198872 | A1 * | 8/2012 | Yamashita | F25B 25/005 62/126 |

FOREIGN PATENT DOCUMENTS

| | | | |
|---|---|---|---|
| JP | H04-103522 | U | 9/1992 |
| JP | H08-054129 | A | 2/1996 |
| JP | H09-126487 | A | 5/1997 |
| JP | 2011-058749 | A | 3/2011 |
| WO | 2008/056602 | A1 | 5/2008 |

* cited by examiner

AIR-CONDITIONING APPARATUS HAVING A DRAIN SENSOR AND ASSOCIATED COMPRESSOR CONTROL

CROSS REFERENCE TO RELATED APPLICATION

This application is a U.S. national stage application of PCT/JP2016/066025 filed on May 31, 2016, the contents of which are incorporated herein by reference.

TECHNICAL FIELD

The present invention relates to an air-conditioning apparatus including a relay unit, and particularly relates to drainage treatment.

BACKGROUND ART

In an air-conditioning apparatus, refrigerant having heat is circulated through a pipe provided between an outdoor unit and an indoor unit, thereby generating conditioned air. In an air-conditioning apparatus capable of simultaneously performing cooling and heating, a relay unit is provided between an outdoor unit and indoor units, and distributes refrigerant to the indoor units.

In the case where refrigerant flows through a pipe in the relay unit, when the surface temperature of the pipe becomes lower than or equal to a dew-point temperature, dew-condensation water generates on the surface of the pipe, and water collects on the bottom of the relay unit.

Patent Literature 1 discloses an example of a method for draining dew-condensation water generated in an indoor unit. Patent Literature 1 discloses that a drain pan which receives dew-condensation water is provided at the indoor unit, a drain port is provided in the drain pan, and a drain hose is connected to the drain port, to thereby drain drainage water to the outside of a building.

CITATION LIST

Patent Literature

Patent Literature 1: International Publication No. WO 2008/056602

SUMMARY OF INVENTION

Technical Problem

The method disclosed in Patent Literature 1 is a method regarding treatment of dew-condensation water in an indoor unit including a heat exchanger. Of various relay units, relay units including no heat exchanger are present. In such a relay unit, the amount of drainage water is smaller than that in an indoor unit, but drainage water is drained using a drain hose as in the indoor unit.

In the case where the method disclosed in Patent Literature 1 is applied to a relay unit, when installing the relay unit, a worker must make a drain port in the relay unit, and set a drain hose to the drain port. Inevitably, it takes much time and effort to install an air-conditioning apparatus, and the cost of installing it is thus increased.

The present invention has been made to solve the above problems, and an object of the invention is to provide an air-conditioning apparatus in which the cost and the time and effort for drainage treatment in a relay unit can be reduced.

Solution to Problem

An air-conditioning apparatus according to an embodiment of the present invention includes: a heat source side unit including a heat-source-side heat exchanger and a compressor; a plurality of load-side units including respective load-side heat exchangers and respective load-side expansion devices; and a relay unit connected between the heat-source-side unit and the plurality of load-side units by a first gas pipe and a first liquid pipe. The relay unit includes a gas/liquid separator which separates refrigerant supplied from the heat-source-side unit into gas refrigerant and liquid refrigerant, a gas-refrigerant supply pipe and a liquid-refrigerant supply pipe which are connected to the gas/liquid separator and each of the plurality of load-side units, a drain pan which is provided in a housing of the relay unit and which receives dew-condensation water, and a heat transfer body which is provided in the drain pan and which is in contact with the liquid-refrigerant supply pipe.

Advantageous Effects of Invention

In an embodiment of the present invention, dew-condensation water generated in a relay unit can be evaporated by heat of a liquid pipe having a high temperature. It is therefore unnecessary to provide a drain port in the relay unit, and to drain water through a drain hose. Thus, it is possible to reduce the time and cost required for setting a drain port and a drain hose.

DESCRIPTION OF EMBODIMENTS

Embodiment 1

Figure 1:
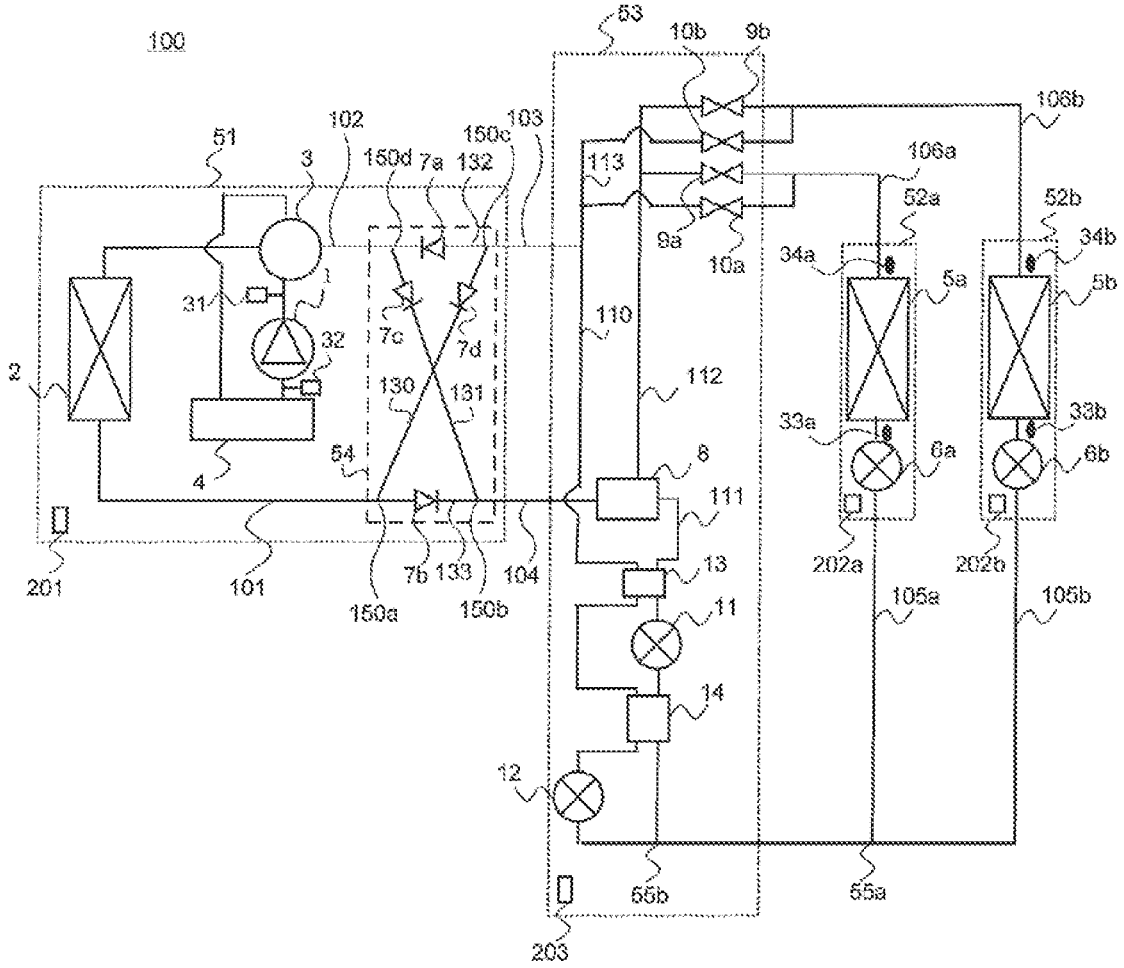
FIG. 1 is a refrigerant circuit diagram illustrating an example of the configuration of an air-conditioning apparatus according to embodiment 1 of the present invention.

An air-conditioning apparatus according to embodiment 1 includes a plurality of load-side units which perform a cooling operation and a heating operation. Also, the air-conditioning apparatus causes the load-side units to perform a cooling only operation, a heating only operation, or a simultaneous cooling and heating operation. FIG. 1 is a refrigerant circuit diagram illustrating an example of the configuration of the air-conditioning apparatus according to embodiment 1 of the present invention. As illustrated in FIG. 1, an air-conditioning apparatus 100 includes a heat-source-side unit 51, a plurality of load-side units 52*a* and 52*b*, and a relay unit 53 provided between the heat-source-side unit 51 and the load-side units 52*a* and 52*b*. The heat-source-side unit 51 and the relay unit 53 are connected to each other by a first gas pipe 103 and a first liquid pipe 104 through which refrigerant flows. The relay unit 53 and the load-side unit 52*a* are connected to each other by a second liquid pipe 105*a* and a second gas pipe 106*a*. The relay unit 53 and the load-side unit 52*b* are connected to each other by a second liquid pipe 105*b* and a second gas pipe 106*b*. The air-conditioning apparatus 100 is an air-conditioning apparatus in which for example, the load-side units 52*a* and 52*b* can independently perform the cooling operation or the heating operation. It should be noted that an operation mode in which the cooling operation and the heating operation are mixedly performed will be referred to as a simultaneous cooling and heating operation mode.

[Configuration of Heat-Source-Side Unit 51]

The heat-source-side unit 51 includes a compressor 1, a four-way valve 3, a heat-source-side heat exchanger 2, an accumulator 4, a refrigerant-flow control unit 54, and a heat-source-side control device 201. The compressor 1 sucks, compresses and discharges refrigerant. As the compressor 1, a compressor, such as an inverter circuit, which can change the amount of refrigerant to be sent therefrom per unit time by performing capacity control, can be applied. A first pressure sensor 31 which detects the pressure of refrigerant provided on a discharge side of the compressor 1. A second pressure sensor 32 which detects the pressure of refrigerant is provided on a suction side of the compressor 1. The first pressure sensor 31 transmits the value of pressure Pd detected to the heat-source-side control device 201. The second pressure sensor 32 transmits a detected value of pressure Ps to the heat-source-side control device 201. The heat-source-side control device 201 functions as a controller which controls the entire air-conditioning apparatus.

The heat-source-side heat exchanger 2 causes refrigerant to circulate therein, and causes heat exchange to be performed between the refrigerant and outdoor air, During the heating operation, the heat-source-side heat exchanger 2 functions as an evaporator, and evaporates and gasifies refrigerant. During the cooling operation, the heat-source-side heat exchanger 2 functions as a condenser, and condenses and liquefies refrigerant. The four-way valve 3 is a valve provided to change the flow of refrigerant. When the flow of the refrigerant is changed by the four-way valve 3, an operation to be performed, such as the cooling operation or the heating operation, is changed. The accumulator 4 stores a surplus of liquid refrigerant. The refrigerant-flow control unit 54 allows refrigerant to flow in only one direction.

[Configuration of Refrigerant-Flow Control Unit 54]

The refrigerant-flow control unit 54 includes connection pipes 130, 131, 132 and 133 which are connected at connection portions 150*a*, 150*b*, 150*c* and 150*d*, and include check valves 7*a*, 7*b*, 7*c* and 7*d* which allow refrigerant to flow in only one direction. The refrigerant-flow control unit 54 is one of structural elements of the heat-source-side unit 51. The connection pipe 130 connects the connection portion 150*c* to the connection portion 150*a*. The connection pipe 131 connects the connection portion 150*d* to the connection portion 150*b*. The connection pipe 132 connects the connection portion 150*c* to the connection portion 150*d*. The connection pipe 133 connects the connection portion 150*a* to the connection portion 150*b*. The first gas pipe 103 connected to the relay unit 53 and a pipe 102 connected to the four-way valve 3 are connected to each other by the connection pipe 132. A low-pressure pipe 101 connected to the heat-source-side heat exchanger 2 and the first liquid pipe 104 connected to the relay unit 53 are connected to each other by the connection pipe 133.

The check valve 7*a* is provided at the connection pipe 132, and allows refrigerant to flow in a direction from the connection portion 150*c* toward the connection portion 150*d*. The check valve 7*b* is provided at the connection pipe 133, and allows refrigerant to flow in a direction from the connection portion 150*a* toward the connection portion 150*b*. The check valve 7*c* is provided at the connection pipe 131, and allows refrigerant to flow in a direction from the connection portion 150*d* toward the connection portion 150*b*. The check valve 7*d* is provided at the connection pipe 130, and allows refrigerant to flow in a direction from the connection portion 150*c* toward the connection portion 150*a*.

[Configuration of Load-Side Units 52*a* and 52*b*]

The load-side units 52*a* includes a load-side heat exchanger 5*a*, a load-side expansion device 6*a* and a load-side control device 202*a*. The load-side unit 52*b* includes a load-side heat exchanger 5*b*, a load-side expansion device 6*b* and a load-side control device 202*b*. The load-side expansion devices 6*a* and 6*b* are, for example, expansion valves. The load-side heat exchangers 5*a* and 5*b* cause refrigerant having passed through the relay unit 53 to circulate through the load-side heat exchangers 5*a* and 5*b*, and cause heat exchange to be performed between the refrigerant and air to be conditioned. During the heating operation, the load-side heat exchangers 5*a* and 5*b* each function as a condenser, and condense and liquefy refrigerant. The second liquid pipes 105*a* and 105*b* connected to the respective load-side expansion devices 6*a* and 6*b* are connected to each other at an indoor trifurcated portion 55*a*. During the cooling operation, the load-side heat exchangers 5*a* and 5*b* each function as an evaporator, and evaporate and gasify refrigerant. The load-side expansion devices 6*a* and 6*b* each function as either a pressure-reducing valve or an expansion valve, and reduce the pressure of refrigerant to expand the refrigerant. The load-side expansion devices 6*a* and 6*b* have only to adjust the pressure of refrigerant in accordance with an air-conditioning load. As the load-side expansion devices 6*a* and 6*b*, for example, flow-rate control units such as electronic expansion valves can be applied.

In the load-side unit 52*a*, a first temperature sensor 33*a* and a second temperature sensor 34*a* are provided. The first temperature sensor 33*a* and the second temperature sensor 34*a* detect temperatures of refrigerant which flows into and flows out of the load-side heat exchanger 5*a*. The first temperature sensor 33*a* and the second temperature sensor 34*a* transmit respective signals indicating the values of the detected temperatures to the load-side control device 202*a*. In the load-side unit 52*b*, a first temperature sensor 33*b* and a second temperature sensor 34*b* are provided. The first temperature sensor 33*b* and the second temperature sensor 34*b* detect temperatures of refrigerant which flows into and flows out of the load-side heat exchanger 5*b*. The first temperature sensor 33*b* and the second temperature sensor

34*b* transmit respective signals indicating the values of the detected temperatures to the load-side control device 202*b*.

Temperature sensors equivalent to the first temperature sensor 33*a* and the second temperature sensor 34*a* may be provided at the heat-source-side heat exchanger 2 in the heat-source-side unit 51. The temperature sensors (not illustrated) provided at the heat-source-side heat exchanger 2 each detect an evaporating temperature when the heat-source-side heat exchanger 2 functions as an evaporator, and detect a condensing temperature when the heat-source-side heat exchanger 2 functions as a condenser.

[Configuration of Relay Unit 53]

The relay unit 53 includes a gas-liquid separator 8, first opening/closing valves 9*a* and 9*b*, second opening/closing valves 10*a* and 10*b*, a first relay-unit expansion device 11, a second relay-unit expansion device 12, a first relay-unit heat exchanger 13, a second relay-unit heat exchanger 14, and a relay-unit control device 203. The first relay-unit expansion device 11 and the second relay-unit expansion device 12 are, for example, expansion valves. The first opening/closing valves 9*a* and 9*b* and the second opening/closing valves 10*a* and 10*b* are, for example, solenoid valves. The gas-liquid separator 8, the first opening/closing valves 9*a* and 9*b*, the second opening/closing valves 10*a* and 10*b*, the first relay-unit expansion device 11, the second relay-unit expansion device 12, the first relay-unit heat exchanger 13, and the second relay-unit heat exchanger 14 are connected by a bypass pipe 110, a liquid-refrigerant supply pipe 111, and a gas-refrigerant supply pipe 112. The relay-unit control device 203 is electrically connected to the first opening/closing valves 9*a* and 9*b*, the second opening/closing valves 10*a* and 10*b*, the first relay-unit expansion device 11, and the second relay-unit expansion device 12, and controls these components. The relay unit 53 is connected to the heat-source-side unit 51 by the first liquid pipe 104 and the first gas pipe 103. The relay unit 53 is also connected to the load-side unit 52*a* by the second liquid pipe 105*a* and the second gas pipe 106*a*. The relay unit 53 is connected to the load-side unit 52*b* by the second liquid pipe 105*b* and the second gas pipe 106*b*. The relay unit 53 controls the flow of refrigerant between the heat-source-side unit 51 and the load-side units 52*a* and 52*b*, and the load-side units 52*a* and 52*b* perform the simultaneous cooling and heating operation. The bypass pipe 110 corresponds to a liquid-refrigerant return pipe provided to return liquid refrigerant to the heat-source-side unit 51.

The gas-liquid separator 8 separates refrigerant into liquid refrigerant and gas refrigerant. The gas-liquid separator 8 is connected to the first liquid pipe 104, the liquid-refrigerant supply pipe 111 and the gas-refrigerant supply pipe 112. The first liquid pipe 104 connects the gas-liquid separator 8 and the connection portion 150*b* of the heat-source-side unit 51 to each other. The liquid-refrigerant supply pipe 111 connects the gas-liquid separator 8 and a relay unit trifurcated portion 55*b* to each other. The gas-refrigerant supply pipe 112 connects the gas-liquid separator 8 and the first opening/closing valves 9*a* and 9*b* to each other.

The second gas pipe 106*a* is branched into part connected to the first opening/closing valve 9*a* and part connected to the second opening/closing valve 10*a*. The second gas pipe 106*b* is branched into part connected to the first opening/closing valve 9*b* and part connected to the second opening/closing valve 10*b*. The second opening/closing valves 10*a* and 10*b* are connected to the bypass pipe 110 and the first gas pipe 103 by a refrigerant return pipe 113. When being in an opened state, the first opening/closing valves 9*a* and 9*b* cause gas refrigerant flowing through the gas-refrigerant supply pipe 112 to pass through the first opening/closing valves 9*a* and 9*b* in a direction in which it flows out of the relay unit 53. When being in a closed state, the first opening/closing valves 9*a* and 9*b* block the gas refrigerant flowing through the gas-refrigerant supply pipe 112. The first opening/closing valves 9*a* and 9*b* are in the opened state when the load-side units 52*a* and 52*b* connected thereto by the second gas pipes 106*a* and 106*b* are performing the heating operation. When being in the opened state, the second opening/closing valves 10*a* and 10*b* cause gas refrigerant flowing through the second gas pipes 106*a* and 106*b* for the load-side units 52*a* and 52*b* to pass through the second opening/closing valves 10*a* and 10*b* in a direction in which the gas refrigerant flows into the relay unit 53. When being in the closed state, the second opening/closing valves 10*a* and 10*b* block the gas refrigerant flowing through the second gas pipes 106*a* and 106*b* for the load-side units 52*a* and 52*b*. The second opening/closing valves 10*a* and 10*b* are in the opened state when the load-side units 52*a* and 52*b* connected thereto by the second gas pipes 106*a* and 106*b* are performing the cooling operation.

The first relay-unit heat exchanger 13 causes liquid refrigerant obtained by the separation process at the gas-liquid separator 8 and liquid refrigerant having flowed through the second relay-unit heat exchanger 14 to flow in the first relay-unit heat exchanger 13, and causes heat exchange to be performed between these liquid refrigerants. The first relay-unit expansion device 11 reduces the pressure of the liquid refrigerant having passed through the first relay-unit heat exchanger 13, and causes the liquid refrigerant to flow into the second relay-unit heat exchanger 14. The second relay-unit heat exchanger 14 causes refrigerant the pressure of which has been reduced by the first relay-unit expansion device 11 and liquid refrigerant the pressure of which has been reduced by the second relay-unit expansion device 12 to flow in the second relay-unit heat exchanger 14, and causes heat exchange to be performed between these refrigerants. The first relay-unit heat exchanger 13, the first relay-unit expansion device 11 and the second relay-unit heat exchanger 14 are interposed between the gas-liquid separator 8 and the relay unit trifurcated portion 55*b*, and are connected by the liquid-refrigerant supply pipe 111. The bypass pipe 110 connects the relay unit trifurcated portion 55*b* and the first gas pipe 103 to each other, with the second relay-unit expansion device 12, the second relay-unit heat exchanger 14 and the first relay-unit heat exchanger 13 interposed between the relay unit trifurcated portion 55*b* and the first gas pipe 103, and recovers liquid refrigerant and returns the liquid refrigerant to the heat-source-side unit 51. As the first relay-unit expansion device 11 and the second relay-unit expansion device 12, for example, flow-rate control units such as electronic expansion valves which can precisely control a flow rate by changing the opening degree may be used.

In embodiment 1, the relay unit 53 has a configuration to treat dew-condensation water. Before explaining the configuration to treat dew-condensation water, the operation of the air-conditioning apparatus 100 will be explained in order that the configuration be clearly understood.

The air-conditioning apparatus 100 performs the cooling only operation, the heating only operation, and the simultaneous cooling and heating operation. The simultaneous cooling and heating operation of the air-conditioning apparatus 100 is classified into a heating main operation in which where a heating load is high and a cooling main operation in which a cooling load is high. Therefore, the air-conditioning apparatus 100 can perform the operation in four modes.

Figure 2:
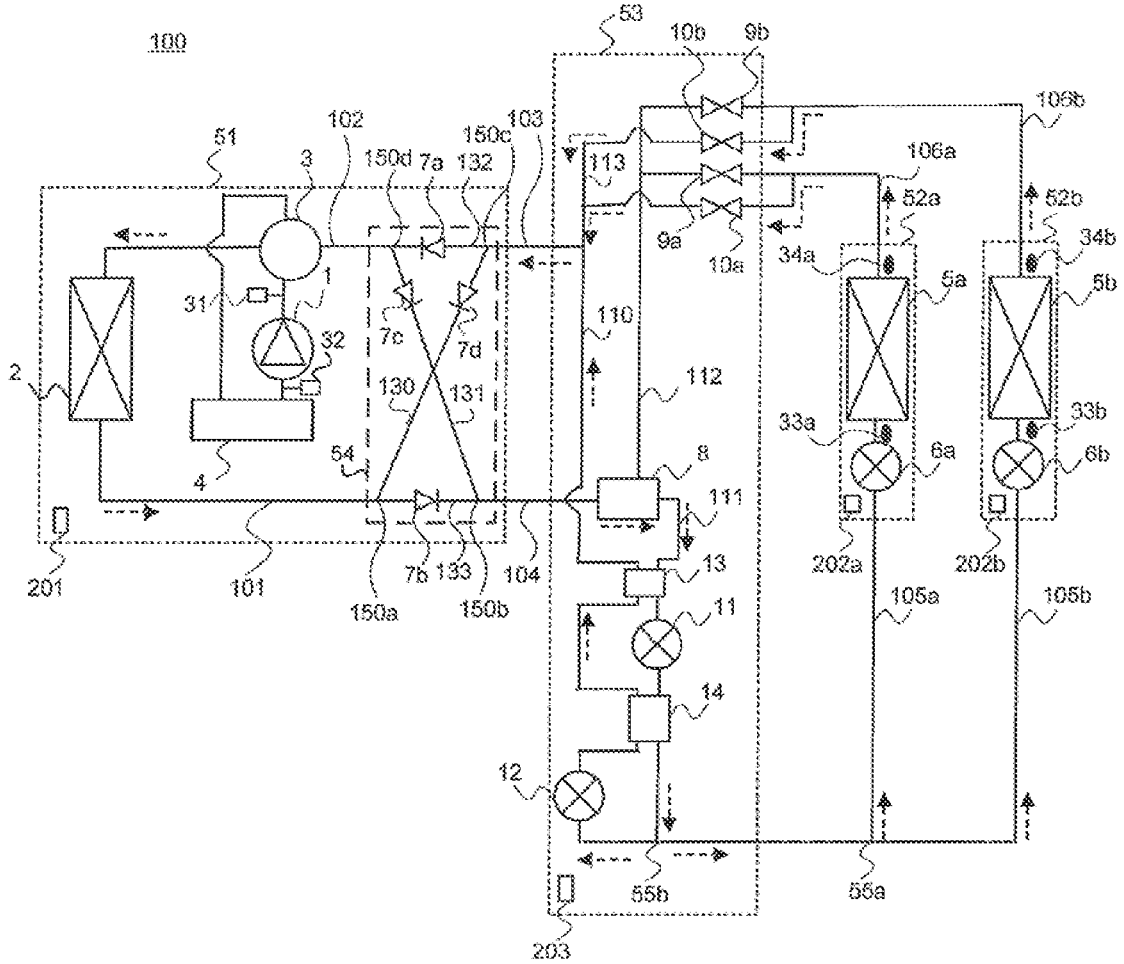
FIG. 2 is a diagram illustrating the flow of refrigerant in a refrigerant circuit during a cooling only operation in the air-conditioning apparatus as illustrated in FIG. 1.

FIG. 2 is a diagram illustrating the flow of refrigerant in the refrigerant circuit during the cooling only operation in the air-conditioning apparatus as illustrated in FIG. 1. In FIG. 2, dashed arrows each indicate the flow direction of refrigerant. During the cooling only operation, both the load-side units 52*a* and 52*b* perform the cooling operation, the first opening/closing valves 9*a* and 9*b* of the relay unit 53 are in the closed state, and the second opening/closing valves 10*a* and 10*b* of the relay unit 53 are in the opened state.

As illustrated in FIG. 2, refrigerant is compressed by the compressor 1 into high-temperature and high-pressure gas refrigerant, and after discharged from the compressor 1, the high-temperature and high-pressure gas refrigerant flows into the heat-source-side heat exchanger 2 through the four-way valve 3. The refrigerant is condensed and liquefied by heat exchange with outdoor air in the heat-source-side heat exchanger 2, and then flows out of the heat-source-side heat exchanger 2. After flowing out of the heat-source-side heat exchanger 2, the refrigerant flows into the refrigerant-flow control unit 54 through the low-pressure pipe 101. In the refrigerant-flow control unit 54, the check valve 7*d* inhibits the refrigerant from entering the connection pipe 130, and the refrigerant thus passes through the check valve 7*b* at the connection pipe 133 and flows out of the refrigerant-flow control unit 54. The refrigerant having passed through the check valve 7*b* flows out of the heat-source-side unit 51, and flows into the relay unit 53.

In the relay unit 53, the refrigerant is separated into liquid refrigerant and gas refrigerant by the gas-liquid separator 8. During the cooling only operation, since all refrigerants are liquid refrigerants, they all flow into the liquid-refrigerant supply pipe 111, that is, no refrigerant flows into the gas-refrigerant supply pipe 112. When the refrigerant flows through the liquid-refrigerant supply pipe 111, at the first relay-unit heat exchanger 13, the degree of subcooling of the refrigerant is increased, and at the first relay-unit expansion device 11, the pressure of the refrigerant is reduced to an intermediate pressure. After passing through the first replay expansion device 11, at the second relay-unit heat exchanger 14, the degree of subcooling of the refrigerant is further increased, and the refrigerant then reaches the relay unit trifurcated portion 55*b*.

At the relay unit trifurcated portion 55*b*, the refrigerant is divided into two, and one of them flows into the bypass pipe 110, and the other flows out of the relay unit 53. The pressure of the refrigerant having flowed into the bypass pipe 110 is reduced to a low pressure at the second relay-unit expansion device 12. After the pressure of the refrigerant is reduced, the refrigerant passes through the second relay-unit heat exchanger 14 and the first relay-unit heat exchanger 13 in turn, and is evaporated by heat exchange to change into gas refrigerant. Then, the gas refrigerant flows into the first gas pipe 103. It should be noted that in the above case, with heat exchange, the refrigerant in the bypass pipe 110 increases the degree of subcooling of the refrigerant flowing through the liquid-refrigerant supply pipe 111.

The refrigerant having flowed from the relay unit 53 after divided at the relay unit trifurcated portion 55*b* flows through the second liquid pipes 105*a* and 105*b*, and flows into the load-side units 52*a* and 52*b*. At each of the load-side expansion devices 6*a* and 6*b* of the load-side units 52*a* and 52*b*, the pressure of the refrigerant is reduced, and at each of the load-side heat exchangers 5*a* and 5*b*, the refrigerant exchanges heat with air in a to-be-air-conditioned space. The refrigerant cools the air in the to-be-air-conditioned space, and is evaporated and gasified to change into gas refrigerant. Then, the gas refrigerant flows out of the load-side heat exchangers 5*a* and 5*b*. Thereby, the to-be-air-conditioned space is cooled.

After flowing out of the load-side heat exchangers 5*a* and 5*b*, the refrigerant flows through the second gas pipes 106*a* and 106*b*, flows out of the load-side units 52*a* and 52*b*, and re-flow into the relay unit 53. In the relay unit 53, the refrigerant passes through the second opening/closing valves 10*a* and 10*b*, which are in the opened state. The refrigerant flows out of the second opening/closing valves 10*a* and 10*b*, passes through the refrigerant return pipe 113, and joins, in the first gas pipe 103, the refrigerant having passed through the bypass pipe 110. Then, the refrigerant flows out of the relay unit 53, and flows into the heat-source-side unit 51.

In the heat-source-side unit 51, the refrigerant passes through the check valve 7*a* provided at the connection pipe 132 in the refrigerant-flow control unit 54, and is sucked into the compressor 1 via the accumulator 4. In such a manner, the refrigerant is circulated in the refrigerant circuit.

Figure 3:
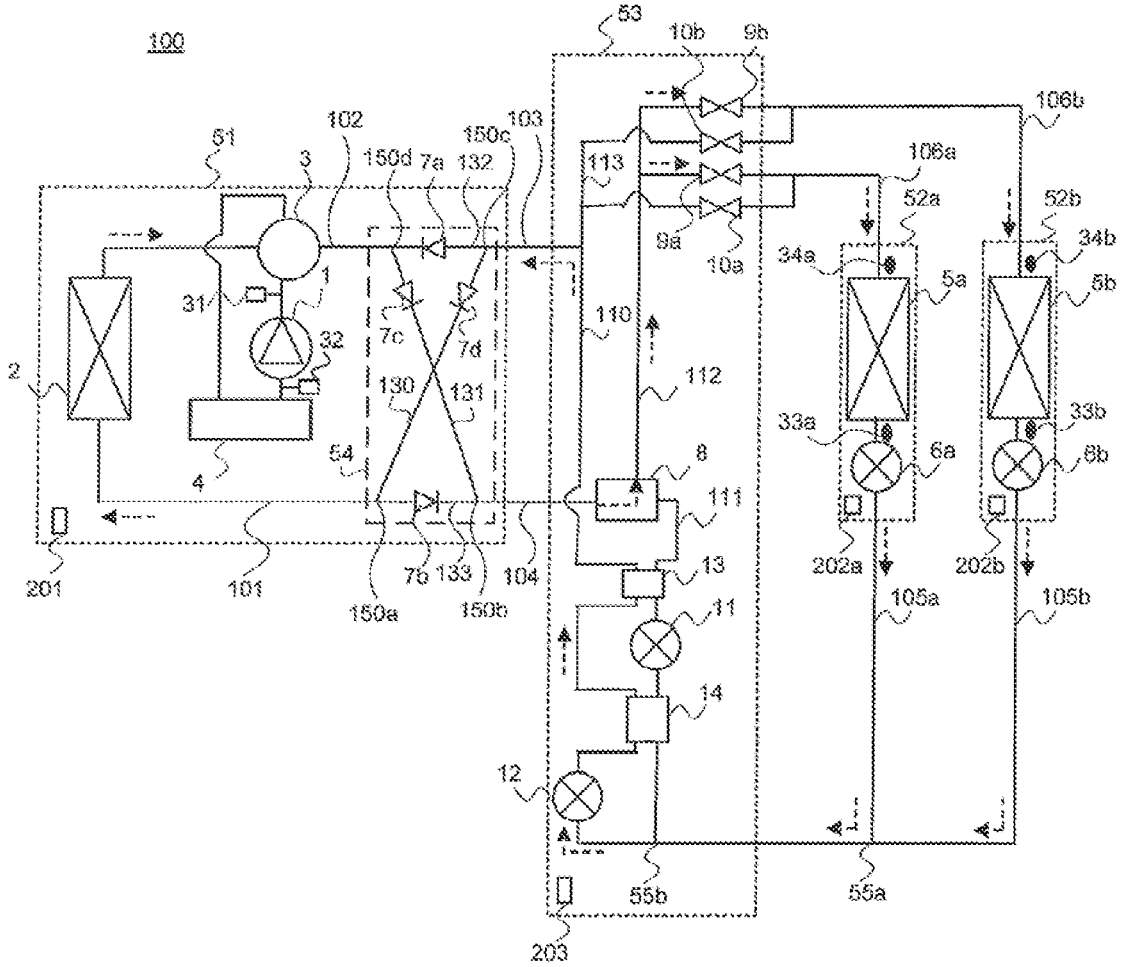
FIG. 3 is a diagram illustrating the flow of refrigerant in the refrigerant circuit during a heating only operation in the air-conditioning apparatus as illustrated in FIG. 1.

FIG. 3 is a diagram illustrating the flow of refrigerant in the refrigerant circuit during the heating only operation in the air-conditioning apparatus as illustrated in FIG. 1. In FIG. 3, dashed arrows each indicate the flow direction of refrigerant. During the heating only operation, both the load-side units 52*a* and 52*b* perform the heating operation.

As illustrated in FIG. 3, refrigerant is compressed by the compressor 1 into high-temperature and high-pressure gas refrigerant, is discharged from the compressor 1, and flows into the refrigerant-flow control unit 54 via the four-way valve 3. After flowing into the refrigerant-flow control unit 54, the refrigerant arrives at the connection portion 150*d*. Since the check valve 7*a* inhibits the refrigerant from flowing from the connection portion 150*d* to the connection pipe 132, the refrigerant flows into the connection pipe 131 and passes through the check valve 7*c*. After passing through the check valve 7*c*, the refrigerant passes through the connection portion 150*b*, and flows out of the heat-source-side unit 51.

After flowing out of the heat-source-side unit 51, the refrigerant flows through the first liquid pipe 104, and flows into the relay unit 53. In the relay unit 53, the refrigerant is separated into gas refrigerant and liquid refrigerant by the gas-liquid separator 8. During the heating only operation, since all refrigerants are gas refrigerant, no refrigerant flows into the liquid-refrigerant supply pipe 111. The refrigerant having passed through the gas-liquid separator 8 reaches the first opening/closing valves 9*a* and 9*b*, passes through the first opening/closing valves 9*a* and 9*b*, which are in the opened state, and flows out of the relay unit 53.

After flowing out of the relay unit 53, the refrigerant flows into the load-side units 52*a* and 52*b*. The refrigerant passes through the second gas pipes 106*a* and 106*b*, and reaches the load-side heat exchangers 5*a* and 5*b*. At the load-side heat exchangers 5*a* and 5*b*, the refrigerant exchanges heat with air in the to-be-air-conditioned space, and is condensed and liquefied while transferring heat to the air in the to-be-air-conditioned space. Thereby, the to-be-air-conditioned space is heated. The refrigerant passes through the load-side heat exchangers 5*a* and 5*b*, and the pressure of the refrigerant is reduced at the load-side expansion devices 6*a* and 6*b*, whereby the refrigerant changes into intermediate-pressure liquid refrigerant. Then, the intermediate-pressure liquid refrigerant flows out of the load-side units 52*a* and 52*b*.

After flowing out of the load-side units 52*a* and 52*b*, the refrigerant flows through the second liquid pipes 105*a* and 105*b*, and flows into the relay unit 53. In the relay unit 53, the refrigerant passes through the relay unit trifurcated portion 55*b*, flows through the bypass pipe 110, and flows into the first gas pipe 103. Then, the refrigerant flows out of the relay unit 53. The refrigerant flows into the heat-source-side unit 51, flows through the first gas pipe 103, and reaches the connection portion 150*c* in the refrigerant-flow control unit 54. At the connection portion 150*c*, the refrigerant cannot flow through the connection pipe 132 having a high pressure, and flows through the check valve 7*d* at the connection pipe 130, and flows through the low-pressure pipe 101. Then, the refrigerant reaches the heat heat-source-side heat exchanger 2 through the low-pressure pipe 101, and while passing through the heat-source-side heat exchanger 2, the refrigerant is evaporated and gasified by heat exchange with outside air. The gasified refrigerant is sucked into the compressor 1 through the four-way valve 3 and the accumulator 4. In such a manner, the refrigerant is circulated in the refrigerant circuit.

The following description is made by referring to the case where in the simultaneous cooling and heating operation, the load-side units 52*a* performs the heating operation, and the load-side units 52*b* performs the cooling operation. In this case, in the relay unit 53, the first opening/closing valve 9*a* and the second opening/closing valve 10*b* are in the opened state, whereas the first opening/closing valve 9*b* and the second opening/closing valve 10*a* are in the closed state.

First, it will be described how refrigerant flows in the cooling main operation in which the cooling load is higher than the heating load. In this case, the refrigerant is compressed by the compressor 1, and subjected to heat exchange at the heat-source-side heat exchanger 2, whereby the refrigerant is condensed and liquefied to change into two-phase gas-liquid refrigerant. Then, the two-phase gas-liquid refrigerant flows out of the heat-source-side heat exchanger 2. The amount of refrigerant to be condensed and liquefied at the heat-source-side heat exchanger 2, that is, the ratio between gas refrigerant and liquid refrigerant, is determined in accordance with the ratio between the cooling load and the heating load. After flowing out of the heat-source-side heat exchanger 2, the refrigerant flows through the low-pressure pipe 101, passes through the check valve 7*b* in the refrigerant-flow control unit 54, flows out of the heat-source-side unit 51, and flows into the relay unit 53 through the first liquid pipe 104.

In the relay unit 53, the refrigerant is separated into liquid refrigerant and gas refrigerant by the gas-liquid separator 8. The liquid refrigerant flows into the liquid-refrigerant supply pipe 111, and the gas refrigerant flows into the gas-refrigerant supply pipe 112.

The degree of subcooling of the liquid refrigerant having flowed into the liquid-refrigerant supply pipe 111 is increased while the refrigerant is passing through the first relay-unit heat exchanger 13, the first relay-unit expansion device 11, and the second relay-unit heat exchanger 14. The refrigerant then reaches the relay unit trifurcated portion 55*b*. At the relay unit trifurcated portion 55*b*, the refrigerant is branches into two, and one of them flows through the bypass pipe 110, and the other flows out of the relay unit 53. The refrigerant having flowed from the relay unit trifurcated portion 55*b* into the bypass pipe 110 is evaporated and gasified by absorbing heat in heat exchange, while passing through the second relay-unit expansion device 12, the second relay-unit heat exchanger 14, and the first relay-unit heat exchanger 13. Then, the refrigerant reaches the first gas pipe 103.

The gas refrigerant having flowed into the gas-refrigerant supply pipe 112 after subjected to the separation process at the gas-liquid separator 8 reaches the first opening/closing valves 9*a* and 9*b*. The refrigerant having reached the first opening/closing valve 9*a*, which is in the opened state, passes through the first opening/closing valve 9*a*, and flows out of the relay unit 53. After flowing out of the relay unit 53, the refrigerant flows into the load-side unit 52*a* through the second gas pipe 106*a*. The refrigerant passes through the load-side heat exchanger 5*a* of the load-side unit 52*a*, and is condensed and liquefied by heat exchange while transferring heat to air in the to-be-air-conditioned space. Thereby, the to-be-air-conditioned space is heated. The pressure of the refrigerant having passed through the load-side heat exchanger 5*a* is reduced by the load-side expansion device 6*a*, whereby the refrigerant is changed into intermediate-pressure liquid refrigerant. The liquid refrigerant flows out of the load-side unit 52*a*, passes through the second liquid pipe 105*a*, and arrives at the indoor trifurcated portion 55*a*.

At the indoor trifurcated portion 55*a*, the refrigerant flowing through the second liquid pipe 105*a* connected to the load-side unit 52*a* joins the refrigerant having flowed out of the relay unit 53, which is one of the two divided refrigerants obtained at the relay unit trifurcated portion 55*b*, that is, those refrigerants are combined into a single refrigerant. The single refrigerant obtained at the indoor trifurcated portion 55*a* flows through the second liquid pipe 105*b*. The pressure of the refrigerant from the second liquid pipe 105*b* is reduced by the load-side expansion device 6*b* in the load-side unit 52*b*, and the refrigerant then flows into the load-side heat exchanger 5*b*. At the load-side heat exchanger 5*b*, the refrigerant is evaporated and gasified by heat exchange with air of the to-be-air-conditioned space, whereby the refrigerant changes into gas refrigerant, and the gas refrigerant flows out of the load-side exchange 5*b*. Thereby, the to-be-air-conditioned space is cooled. After flowing out of the load-side heat exchanger 5*b*, the refrigerant passes through the second opening/closing valve 10*b*, which is in the opened state, and reaches the first gas pipe 103 through the refrigerant return pipe 113.

The refrigerant having passed through the second opening/closing valve 10*b* joins the refrigerant having passed through the bypass pipe 110 and also having reached the first gas pipe 103, that is, those refrigerants are combined into a single refrigerant. This single refrigerant flows through the first gas pipe 103, and flows into the refrigerant-flow control unit 54 in the heat-source-side unit 51. The refrigerant passes through the check valve 7*a* provided on the connection pipe 132 of the refrigerant-flow control unit 54, and is sucked into the compressor 1 via the four-way valve 3 and the accumulator 4. In such a manner, refrigerant is circulated in the refrigerant circuit.

Next, it will be described how refrigerant flows in the heating main operation in which the heating load is higher than the cooling load. The refrigerant is compressed by the compressor 1, is discharged therefrom, passes through the four-way valve 3, and reaches the connection portion 150*d* of the refrigerant-flow control unit 54. Since the check valve 7*a* inhibits the refrigerant from flowing from the connection portion 150*d* into the connection pipe 132, the refrigerant passes through the check valve 7*c* provided at the connection pipe 131. After passing through the check valve 7*c*, the refrigerant flows out of the heat-source-side unit 51 via the first liquid pipe 104, and flows into the relay unit 53.

In the relay unit 53, the refrigerant flows into the gas-refrigerant supply pipe 112 from the gas-liquid separator 8. Since the heating main operation is being performed, no liquid refrigerant is separated from the above refrigerant by the gas-liquid separator 8, and thus no refrigerant flows into the liquid-refrigerant supply pipe 111. The refrigerant flows through the gas-refrigerant supply pipe 112, and reaches the first opening/closing valves 9*a* and 9*b*. The refrigerant having reached the first opening/closing valve 9*a*, which is in the opened state, passes through the first opening/closing valve 9*a*, flows out of the relay unit 53, and flows into the load-side unit 52*a* through the second gas pipe 106*a*. In the load-side unit 52*a*, the refrigerant passes through the load-side heat exchanger 5*a*, and is condensed and liquefied by heat exchange while transferring heat to air of the to-be-air-conditioned space. Thereby, the to-be-air-conditioned space is heated. After the refrigerant passes through the load-side heat exchanger 5*a*, the pressure of the refrigerant is reduced at the load-side expansion device 6*a*, whereby the refrigerant changes into intermediate-pressure liquid refrigerant. The liquid refrigerant flows out of the load-side units 52*a*, and then flows into the second liquid pipe 105*a*, and reaches the indoor trifurcated portion 55*a*.

At the indoor trifurcated portion 55*a*, the refrigerant is divided into two. One of them flows into the relay unit 53, and then flows through the bypass pipe 110; and the other flows into the load-side unit 52*b* through the second liquid pipe 105*b*, its pressure is reduced by the load-side expansion device 6*b* in the load-side unit 52*b*, and it then exchanges heat with air of the to-be-air-conditioned space, at the load-side heat exchanger 5*b*. Thereby, the refrigerant flowing through the load-side heat exchanger 5*b* is evaporated and gasified, and the to-be-air-conditioned space is cooled. Then, the refrigerant from the load-side heat exchanger 5*b* flows through the second gas pipe 106*b*, and passes through the second opening/closing valve 10*b*, which is in the opened state.

After passing through the second opening/closing valve 10*b*, the refrigerant passes through the refrigerant return pipe 113, and joins the refrigerant having flowed through the bypass pipe 110, as a result of which these refrigerants are combined into a single refrigerant. This single refrigerant reaches the first gas pipe 103, and flows out of the relay unit 53. After flowing out of the relay unit 53, the refrigerant flows into the heat-source-side unit 51 through the first gas pipe 103. In the refrigerant-flow control unit 54 of the heat-source-side unit 51, the refrigerant passes through the check valve 7*d* provided at the connection pipe 130, and flows into the heat-source-side heat exchanger 2 through the low-pressure pipe 101. At the heat-source-side heat exchanger 2, the refrigerant is evaporated and gasified by heat exchange, and is sucked into the compressor 1 via the four-way valve 3 and the accumulator 4. In such a manner, refrigerant is circulated in the refrigerant circuit.

As explained above, whichever of the cooling only operation, the heating only operation, the heating main operation and the cooling main operation is performed by the load-side units 52*a* and 52*b*, low-pressure and low temperature refrigerant flow in part of the bypass pipe 110 in the relay unit 53, which extends from the second relay-unit expansion device 12 to a connection point where the bypass pipe 110 joins the first gas pipe 103. When the surface temperature of the bypass pipe 110 becomes lower than or equal to the dew point of ambient air, dew-condensation water may be generated on the surface of the above part of the bypass pipe 110.

[Configuration for Treating Dew-Condensation Water in Relay Unit 53]

Figure 4:
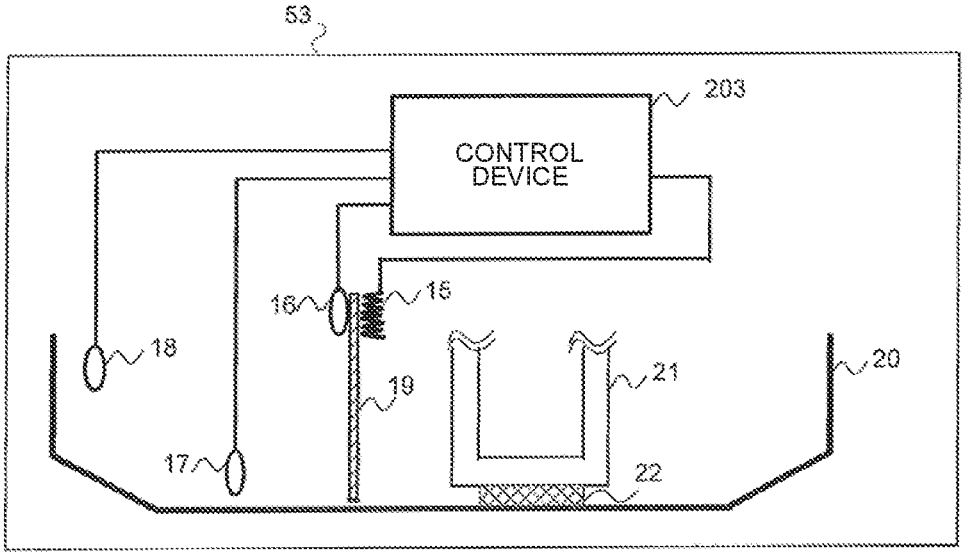
FIG. 4 is a cross sectional view of an example of the configuration of a main portion which performs dew-condensation water treatment in a relay unit as illustrated in FIG. 1.

Next, the configuration to treat dew-condensation water in the relay unit 53 will be described. FIG. 4 is a cross sectional view of an example of the configuration of a main portion of the relay unit as illustrated in FIG. 1, which is provided to treat dew-condensation water. The relay unit 53 includes a drain pan 20 provided to receive dew-condensation water generated in the relay unit 53. In a housing of the relay unit 53, it suffices that the drain pan 20 is provided at least below a refrigerant pipe. The drain pan 20 includes a heat transfer pipe 22 provided at the bottom of the inside of the drain pan 20. A pipe 21 is provided in contact with the heat transfer pipe 22. The pipe 21 is a portion of the liquid-refrigerant supply pipe 111 as illustrated in FIG. 1, which extends from the gas-liquid separator 8 to the first relay-unit heat exchanger 13. During the cooling only operation or the cooling main operation of the load-side units 52*a* and 52*b*, high-temperature refrigerant flows through the pipe 21, and the temperature of the pipe 21 is thus raised.

The heat transfer pipe 22 is a pipe provided to transfer heat of the pipe 21 to dew-condensation water collected in the drain pan 20. The heat transfer pipe 22 is provided on the bottom surface of the drain pan 20. Use of the heat transfer pipe 22 is intended to prevent corrosion of the pipe 21 which would occur if the pipe 21 in which refrigerant flows were brought into direct contact with water, as a result of which a hole would be formed in the pipe 21, and the refrigerant would leak from the pipe 21. Therefore, in the configuration as illustrated in FIG. 4, the heat of the pipe 21 is transferred to the dew-condensation water via the heat transfer pipe 22 through which no refrigerant flows. The heat transfer pipe 22 as illustrated in FIG. 4 is merely an example, and the height of the heat transfer pipe 22 may be greater than that illustrated in FIG. 4.

The drain pan 20 is provided with a drain sensor 17 which detects whether or not water is collected in the drain pan 20, a heater 15 which evaporates water collected in the drain pan 20, and a float switch 18 which detects the water level of water collected in the drain pan 20. The electric power to be supplied to the heater 15 is determined on the basis of the amount of dew-condensation water generated in the relay unit 52, the evaporation latent heat of water, etc. The amount of dew-condensation water to be generated in the relay unit 53 is calculated in advance by an experiment, etc.

In the example of the configuration as illustrated in FIG. 4, a heat-transfer metal plate 19 which transfers heat of the heater 15 to dew-condensation water collected in the drain pan 20 is provided in contact with the heater 15. A temperature sensor 16 which detects the temperature of the heater 15 is provided in contact with the heat-transfer metal plate 19. In order to prevent disconnection of the heater 15 from occurring due to abnormal heating, the temperature sensor 16 monitors the temperature of the heater 15. The temperature sensor 16 is, for example, a thermistor. In the case where the heater 15 is made of a waterproof material, the heat-transfer metal plate 19 may be omitted. The float switch 18 is provided to stop the operation of the air-conditioning apparatus 100 before an overflow of dew-condensation water from the drain pan 20, in order to prevent an outflow of dew-condensation water from the relay unit 53. The state of the float switch 18 is switched from an off-state to an on-state when the water level of dew-condensation water reaches an upper limit which is a water level of the water in the drain pan 20 just before the water flows over from the drain pan 20.

The drain sensor 17 is set at a higher position than a lower end of the heat-transfer metal plate 19 but at a lower position than a surface of the heat transfer pipe 22 which is in contact with the pipe 21. When the drain sensor 17 detects dew-condensation water, the dew-condensation water is in contact with the heat-transfer metal plate 19 and the heat transfer pipe 22. The float switch 18 is installed at a higher position than the drain sensor 17 but at a lower position than a lower end of the heater 15 and an edge of the drain pan 20. In the configuration example as illustrated in FIG. 4, the heater 15 is located at a higher position than the float switch 18. However, in the case where the heater 15 is formed of a waterproof material, the heater 15 is installed at a lower position than the drain sensor 17.

The temperature sensor 16, the drain sensor 17, and the float switch 18 are connected to the relay-unit control device 203 by respective signal lines. The heater 15 is connected to the relay-unit control device 203 by an electric power supply line. The temperature sensor 16 transmits the value of a temperature T2 of the heater 15 to the relay-unit control device 203. When detecting water, the drain sensor 17 transmits an on signal as a detection signal to the relay-unit control device 203. When not detecting water, the drain sensor 17 transmits an off signal as a detection signal to the relay-unit control device 203. When the water level of dew-condensation water collected in the drain pan 20 reaches the upper limit, the state of the float switch 18 is switched from the off state to the on state, and transmits an on signal as a detection signal to the relay-unit control device 203.

In the configuration as illustrated in FIG. 4, when dew-condensation water is generated in the relay unit 53, in the case where the load-side units 52*a* and 52*b* is performing the cooling only operation or the cooling main operation, it is possible to evaporate the dew-condensation water with heat of refrigerant flowing through the pipe 21. In the case where the amount of heat of the pipe 21 is insufficient and the drain sensor 17 detects water, heat of the heater 15 can also be applied to evaporation of the dew-condensation water. When dew-condensation water is generated in the relay unit 53, in the case where the load-side units 52*a* and 52*b* is performing the heating only operation or the heating main operation, the dew-condensation water can be evaporated with heat of the heater 15.

It should be noted that the configuration as illustrated in FIG. 4 is an example. In the example of the configuration as illustrated in FIG. 4, the heat transfer pipe 22 is provided on the bottom of the drain pan 20. However, the position of the heat transfer pipe 22 is not limited to the bottom of the drain pan 20. For example, in the case the drain pan 20 is formed of a material having high heat conductivity, such as metal, it suffices that the heat transfer pipe 22 is provided in contact with the drain pan 20, and the position of the heat transfer pipe 22 is not limited to the bottom of the drain pan 20. That is, it suffices that the heat transfer pipe 22 is provided at least within space inward of an inner surface of the drain pan 20. This is because it suffices that the heat transfer pipe 22 can supply heat to water in the drain pan 20. Moreover, a medium for supplying heat from the pipe 21 to dew-condensation water is not limited to the heat transfer pipe 22, that is, any heat transfer body can be applied as such a medium as long as it is not easily corroded by water and has high heat conductivity.

[Configuration of Control Unit of Air-Conditioning Apparatus 100]

Figure 5:
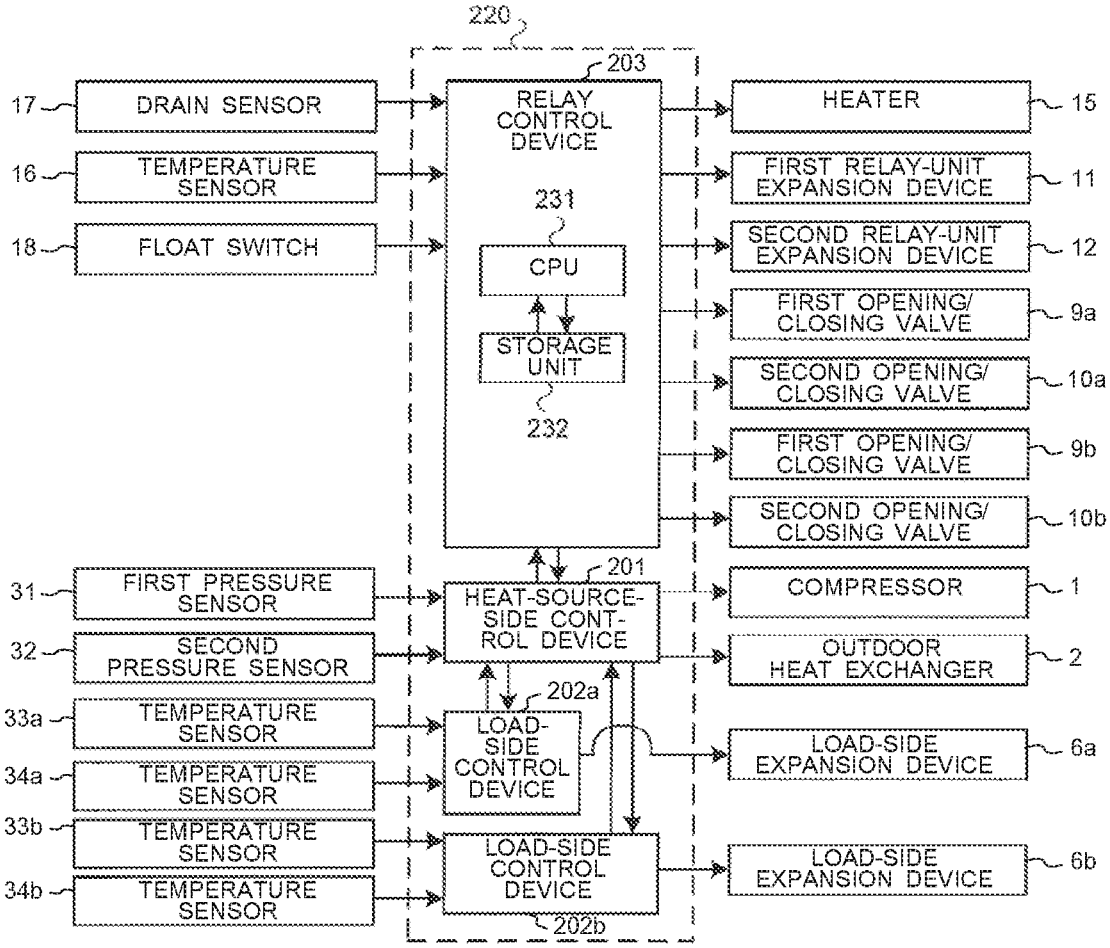
FIG. 5 is a functional block diagram illustrating an example of a configuration related to control to be performed by the air-conditioning apparatus as illustrated in FIG. 1.

Next, a configuration related to control to be performed by the air-conditioning apparatus 100 will be described. FIG. 5 is a functional block diagram illustrating an example of the configuration related to the control by the air-conditioning apparatus as illustrated in FIG. 1. The air-conditioning apparatus 100 includes a controller 220 including the heat-source-side control device 201, the load-side control devices 202*a* and 202*b* and the relay-unit control device 203. As illustrated in FIG. 5, the heat-source-side control device 201 is connected to the load-side control devices 202*a* and 202*b* and the relay-unit control device 203 by respective signal lines. In the control by the air-conditioning apparatus 100, the heat-source-side control device 201 functions as a main controller.

Each of the heat-source-side control device 201, the load-side control devices 202*a* and 202*b* and the relay-unit control device 203 is, for example, a microcomputer. As illustrated in FIG. 5, the relay-unit control device 203 includes a storage unit 232 which stores a program, and a central processing unit (CPU) 231 which executes processing in accordance with the program. Although it is not illustrated, the heat-source-side control device 201 and the load-side control devices 202*a* and 202*b* each include a CPU and a storage unit, as well as the relay-unit control device 203.

Figure 6:
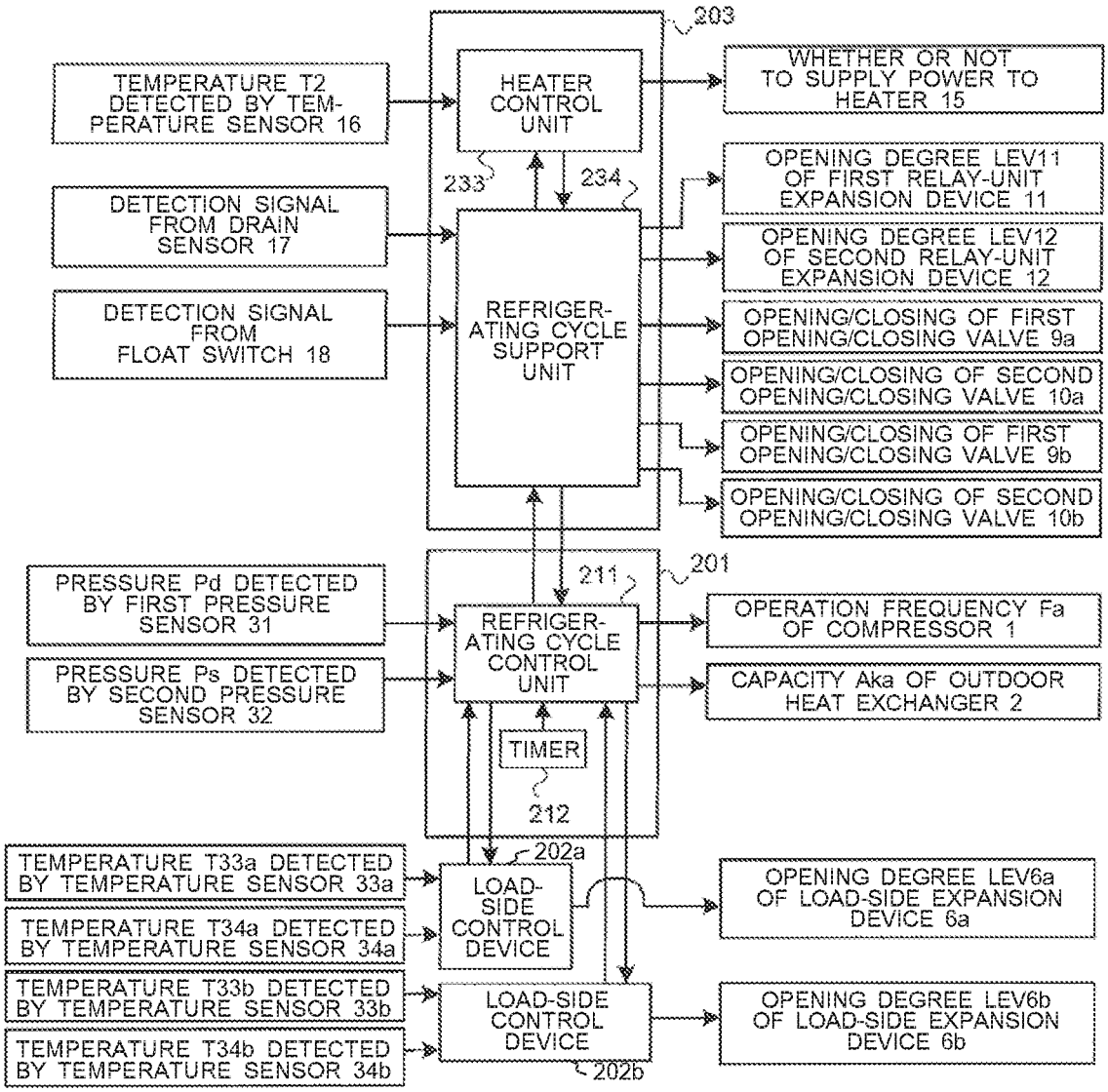
FIG. 6 is a functional block diagram illustrating an example of a specific configuration of a controller as illustrated in FIG. 5.

FIG. 6 is a functional block diagram illustrating a specific example of the configuration of the control unit as illustrated in FIG. 5. As illustrated in FIG. 6, the heat-source-side control device 201 includes a timer 212 for measuring time, and a refrigerating-cycle control unit 211 which controls a refrigerating cycle in the air-conditioning apparatus 100. In the heat-source-side control device 201, the CPU (not illustrated) executes a program, whereby the refrigerating-cycle control unit 211 is provided. The refrigerating-cycle control unit 211 determines instructions to the load-side control devices 202*a* and 202*b* and the relay-unit control device 203 on the basis of information given from the load-side control devices 202*a* and 202*b* and the relay-unit control device 203, and notifies the control devices of the determined instructions. The refrigerating-cycle control unit 211 acquires a pressure Pd detected by the first pressure sensor 31 provided on the discharge side of the compressor 1, from the first pressure sensor 31. The refrigerating-cycle control unit 211 acquires a pressure Ps detected by the second pressure sensor 32 provided on the suction side of the compressor 1, from the second pressure sensor 32. The refrigerating-cycle control unit 211 controls an operation frequency Fa of the compressor 1 and a capacity AKa of the heat-source-side heat exchanger 2 on the basis of the pressure Pd and the pressure Ps.

When receiving an instruction to increase the operation frequency Fa of the compressor 1 from the relay-unit control device 203, the refrigerating-cycle control unit 211 instructs the compressor 1 to increase the operation frequency Fa. When the time measured by the timer 212 exceeds a predetermined time after the condensing temperature of the heat-source-side heat exchanger 2 reaches a target condensing temperature, the refrigerating-cycle control unit 211 notifies the relay-unit control device 203 that a heat-amount addition determining time which is time at which it should be determined whether or not to add an amount of heat has come. When receiving, from the relay-unit control device 203, information indicating that supplying of electric power to the heater 15 has been started, the refrigerating-cycle control unit 211 notifies the relay-unit control device 203 of the timing at which it should be determined whether or not to continue supplying of electric power to the heater 15, on the basis the time measured by the timer 212. Upon reception of an instruction to stop the operation of the air-conditioning apparatus 100, which is given from the relay-unit control device 203, the refrigerating-cycle control unit 211 stops the operation of the load-side units 52*a* and 52*b*.

The load-side control device 202*a* acquires from the first temperature sensor 33*a*, a temperature T33*a* detected by the first temperature sensor 33*a*, and acquires from the second temperature sensor 34*a*, a temperature T34*a* detected by the second temperature sensor 34*a*. The load-side control device 202*a* notifies the heat-source-side control device 201 of the acquired temperatures T33*a* and T34*a*. The load-side control device 202*a* calculates an opening degree LEV6*a* of the load-side expansion device 6*a* on the basis of the temperatures T33*a* and T34*a*, and notifies the load-side expansion device 6*a* of the calculated opening degree LEV6*a*.

The load-side control device 202*b* acquires from the first temperature sensor 33*b*, a temperature T33*b* detected by the first temperature sensor 33*b*, and acquires from the second temperature sensor 34*b*, a temperature T34*b* detected by the second temperature sensor 34*b*. The load-side control device 202*b* notifies the heat-source-side control device 201 of the acquired temperatures T33*b*, T34*b*. The load-side control device 202*b* calculates an opening degree LEV6*b* of the load-side expansion device 6*b* on the basis of the temperature T33*b* and the temperature T34*b*, and notifies the load-side expansion device 6*b* of the calculated opening degree LEV6*b*.

The relay-unit control device 203 includes a refrigerating-cycle support unit 234 which controls the refrigerating cycle in accordance with an instruction from the refrigerating-cycle control unit 211 and a heater control unit 233 which determines whether or not to supply electric power to the heater 15. In the relay-unit control device 203, the CPU 231 as illustrated in FIG. 5 executes a program, whereby the heater control unit 233 and the refrigerating-cycle support unit 234 are provided. In response to an instruction from the refrigerating-cycle control unit 211, the refrigerating-cycle support unit 234 notifies the first relay-unit expansion device 11 of the opening degree LEV11, and also notifies the second relay-unit expansion device 12 of the opening degree LEV 12. In response to an instruction from the refrigerating-cycle control unit 211, the refrigerating-cycle support unit 234 instructs the first opening/closing valves 9*a* and 9*b* and the second opening/closing valves 10*a* and 10*b* to be opened/closed. For example, in the cooling only operation in FIG. 2, in response to an instruction from the refrigerating-cycle support unit 234, the refrigerating-cycle support unit 234 instructs the first opening/closing valves 9*a* and 9*b* to be closed, and instructs the second opening/closing valves 10*a* and 10*b* to be opened.

In accordance with a detection signal received from the drain sensor 17 which detects whether dew-condensation water is generated or not, the refrigerating-cycle support unit 234 determines whether or not to increase the operation frequency Fa of the compressor 1. In the case of increasing the operation frequency Fa of the compressor 1, the refrigerating-cycle support unit 234 instructs the refrigerating-cycle control unit 211 to increase the operation frequency Fa of the compressor 1. When receiving, from the refrigerating-cycle control unit 211, information indicating that time measured by the timer 212 has reached the heat-amount addition determining time, the refrigerating-cycle support unit 234 notifies the heater control unit 233 of the information. In addition, the refrigerating-cycle support unit 234 monitors a detection signal from the float switch 18. When receiving an on signal from the float switch 18, the refrigerating-cycle support unit 234 instructs the refrigerating-cycle control unit 211 to stop the operation of the air-conditioning apparatus 100.

The heater control unit 233 determines whether or not to supply electric power to the heater 15, on the basis of a detection signal from the drain sensor 17 and information indicating that the time measured by the timer 212 has reached the heat-amount addition determining time. The heater control unit 233 monitors the temperature T2 of the heater 15 which is detected by the temperature sensor 16, and determines whether or not to continue supplying of electric power to the heater 15 on the basis of whether or not the temperature T2 has reached a predetermined temperature Ta. The temperature Ta is a criterion of determination whether heating by the heater 15 is abnormal or not. When supplying of electric power to the heater 15 starts, the heater control unit 233 notifies the refrigerating-cycle control unit 211 of the starting of supplying of electric power to the heater 15, via the refrigerating-cycle support unit 234.

[Way of Control for Refrigerating Cycle which is Performed by Air-Conditioning Apparatus 100]

Next, of various controls of the refrigerating cycle which are to be performed by the air-conditioning apparatus 100, a control for the degree of superheat will be explained by way of example. Since the load-side unit 52*a* and the load-side unit 52*b* have the same configuration, it will be described how the super heat in the load-side units 52*a* is controlled.

Figure 7:
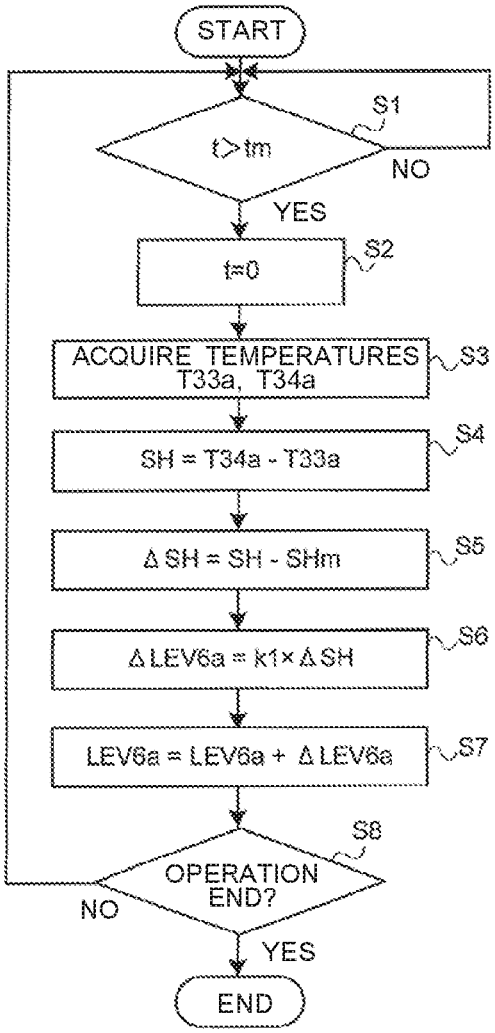
FIG. 7 is a flowchart indicating a procedure of determination of the opening degree of a load-side expansion device in a load-side unit as illustrated in FIG. 1.

FIG. 7 is a flowchart of a procedure of determining the opening degrees of the load-side expansion devices in the load-side units as illustrated in FIG. 1. The opening degree LEV6*a* of the load-side expansion device 6*a* is controlled by a controller which controls the entire air-conditioning apparatus. In an example illustrated in FIG. 7, the opening degree LEV6*a* is controlled by the heat-source-side control device 201, as described with reference to FIGS. 5 and 6. It is assumed that information regarding time tx1 in the procedure as described below is stored in advance in a storage unit not illustrated, which is provided in the heat-source-side control device 201.

When the operation of the load-side unit 52*a* starts, the heat-source-side control device 201 acquires an initial value LEV6 of the opening degree LEV6*a* of the load-side expansion device 6*a* from the load-side control device 202*a*, and causes the timer 212 to start to measure time. In step S1, the heat-source-side control device 201 determines whether the time measured by the timer 212 has exceeded a predetermined time tm or not. When the heat-source-side control device 201 determines that the measured time has exceeded the time tm, the step to be carried out proceeds to step S2 to reset the timer 212 to zero the value indicated thereby, and the step then proceeds to step S3. In step S3, the heat-source-side control device 201 acquires the temperature T33*a* and the temperature T34*a* detected by the first temperature sensor 33*a* and the second temperature sensor 34*a*. The temperature T33*a* and the temperature T34*a* represent the saturation temperature of refrigerant and the temperature of refrigerant. In step S4, the load-side control device 202*a* calculates the difference SH between the temperature T33*a* and the temperature T34*a*. The load-side control device 202*a* notifies the heat-source-side control device 201 of the calculated difference SH.

In step S5, the heat-source-side control device 201 calculates a difference ΔSH between the temperature difference SH and a target temperature difference SHm. The heat-source-side control device 201 notifies the load-side control device 202*a* of the difference ΔSH. In step S6, the load-side control device 202*a* calculates a correction value ΔLEV6*a* for the opening degree of the load-side expansion device 6*a*. The correction value ΔLEV6*a* may be obtained by, for example, calculating a coefficient k1 in advance in experiment or the like, and multiplying a coefficient k2 and the difference ΔSH together. In step S7, the load-side control device 202*a* adds the correction value ΔLEV6*a* to the current opening degree LEV6*a* of the load-side expansion device 6*a* to obtain a value, and sets the obtained value as a new opening degree LEV6*a* of the load-side expansion device 6*a*.

In step S8, the heat-source-side control device 201 determines whether an instruction to end the operation of the load-side unit 52*a* has been inputted to the heat-source-side control device 201 or not. When determining that the instruction to end the operation of the load-side unit 52*a* has been input to the heat-source-side control device 201, the heat-source-side control device 201 ends the operation of the load-side unit 52*a*, In order to end the operation of the load-side unit 52*a*, for example, it suffices to fully close the load-side expansion device 6*a*. When the heat-source-side control device 201 is not given an instruction to end the operation of the load-side unit 52*a*, the step to be carried out returns to step S1, and the processes of steps S1 to S8 are repeated at intervals of predetermined time tx1. In step S8, not only in the case where the instruction to end the operation of the load-side unit 52*a* is input thereto, but in the case where abnormality occurs in the load-side unit 52*a*, the source-side control device 201 may determine to end the operation of the load-side unit 52*a*.

[Way of Treating Dew-Condensation Water in Relay Unit 53]

Figure 8:
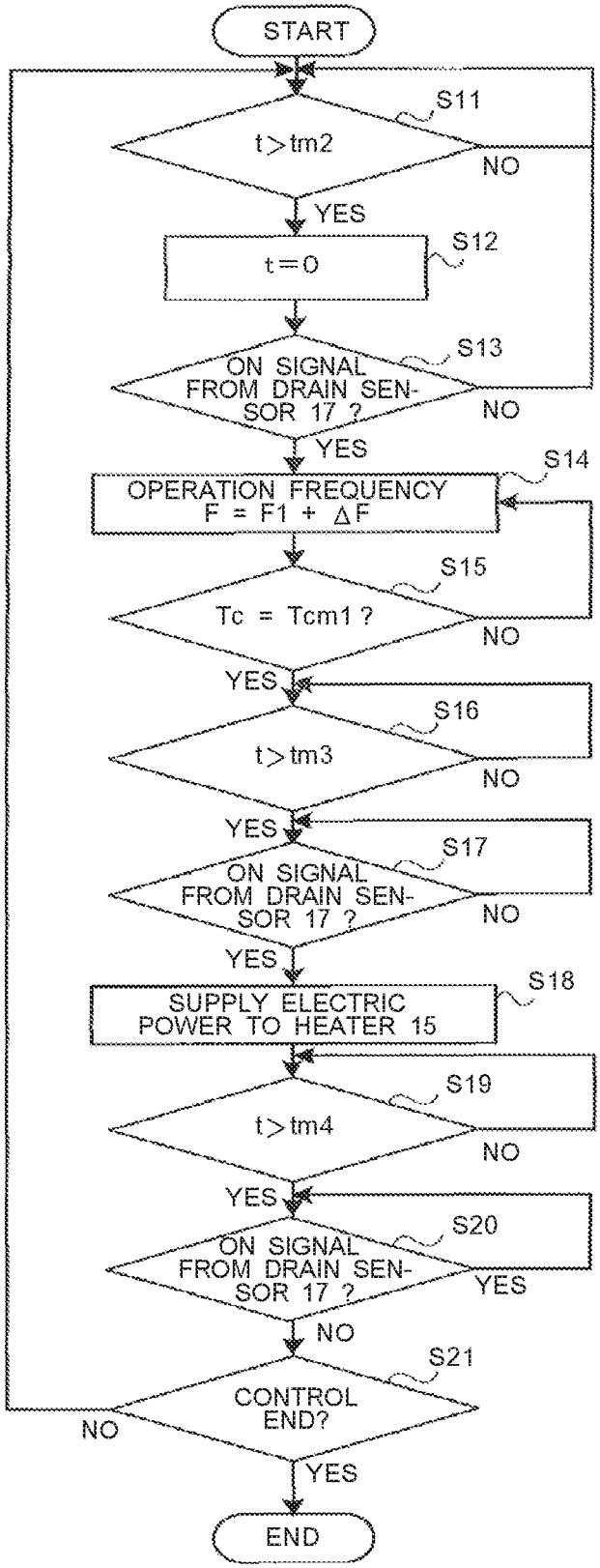
FIG. 8 is a flowchart showing a procedure of dew-condensation water treatment to be performed by a heat-source-side control device and a relay-unit control device as illustrated in FIG. 6.

Next, it will be described how to treat dew-condensation water in the relay unit 53. FIG. 8 is a flowchart illustrating a procedure of treatment of dew-condensation water, which is performed by the heat-source-side control device and the relay-unit control device as illustrated in FIG. 6. It is assumed that information regarding an increase rate ΔF of an operation frequency, a target condensing temperature Tcm1, time tx2 and times tm2 to tm4 in the procedure, which will be described below, is stored in advance in the storage unit (not illustrated) in the heat-source-side control device 201. Also, it is assumed that the load-side units 52*a* and 52*b* perform the cooling only operation or the cooling main operation.

As indicated in FIG. 8, when the operation of the load-side units 52*a* and 52*b* starts, the heat-source-side control device 201 causes the timer 212 to start to measure time. In step S11, the heat-source-side control device 201 determines whether the predetermined time tm2 has elapsed or not. When determining that the time tm2 has elapsed, in step S12, the heat-source-side control device 201 resets the timer 212 to zero the time measured thereby, and instructs the relay-unit control device 203 to execute the process of step S13. In step S13, the relay-unit control device 203 determines whether dew-condensation water is collected in the drain pan 20 or not on the basis of a detection signal from the drain sensor 17. As described above with reference to FIG. 4, it suffices that the drain sensor 17 is provided close to the bottom surface of the drain pan 20. In step S13, when it is determined that dew-condensation water is collected in the drain pan 20, the step to be carried out proceeds to step S14, and when it is determined that dew-condensation water is not collected in the drain pan 20, the step to be carried out returns to step S11. In step S13, when it is determined that dew-condensation water is collected in the drain pan 20, since the heat transfer pipe 22 is in contact with the dew-condensation water, heat of the pipe 21 is transferred to the dew-condensation water, and promotes evaporation thereof. Also, in S13, when it is determined that dew-condensation water is collected in the drain pan 20, the relay-unit control device 203 instructs the heat-source-side control device 201 to increase the operation frequency of the compressor 1.

In step S14, the heat-source-side control device 201 instructs the compressor 1 to increase the operation frequency thereof by a frequency ΔF which is set to be added, and the step to be carried out then proceeds to step S15. The frequency ΔF to be added to a current value F1 of the operation frequency is determined in advance by conducting experiment, etc. In the compressor 1, when the operation frequency thereof is increased, a discharge pressure is increased, and a condensing temperature Tc is increased. The condensing temperature Tc is found from a saturation temperature determined from a pressure detected by the first pressure sensor 31. In step S15, the heat-source-side control device 201 determines whether the condensing temperature Tc is equal to a target condensing temperature Tcm1 or not. Also, the target condensing temperature Tcm1 is determined in advance by conducting an experiment, etc. When the heat-source-side control device 201 determines that the condensing temperature Tc has not reached the target condensing temperature Tcm1, the heat-source-side control device 201 returns to the process of step S14. When the heat-source-side control device 201 determines that the condensing temperature Tc has reached the target condensing temperature Tcm1, the heat-source-side control device 201 proceeds to step S16. In step S16, the heat-source-side control device 201 causes the timer 212 to start to measure time. The heat-source-side control device 201 determines whether or not predetermined time tm3 has elapsed after the condensing temperature Tc reached the target condensing temperature Tcm1. The time tm3 corresponds to the heat-amount addition determining time. When determining that the time tm3 has elapsed, in step S16, the heat-source-side control device 201 resets the timer 212 to zero the time measured thereby. Subsequently, the heat-source-side control device 201 notifies the relay-unit control device 203 of the elapse of the time tm3, and instructs the relay-unit control device 203 to execute the process of step S17. In the case where a temperature sensor not illustrated is provided at the heat-source-side heat exchanger 2, the condensing temperature Tc may be detected by the temperature sensor.

In step S17, the relay-unit control device 203 determines whether or not dew-condensation water is collected in the drain pan 20 on the basis of the detection signal from the drain sensor 17. When it is determined that dew-condensation water is collected in the drain pan 20, the step to be carried out proceeds to step S18. When it is determined that dew-condensation water is not collected in the drain pan 20, the step to be carried out returns to step S16. In step S18, the relay-unit control device 203 starts supplying of electric power to the heater 15. In step S19, the heat-source-side control device 201 determines whether or not predetermined time tm4 has elapsed after the start of supplying of electric power to the heater 15. When determining that the time tm4 has elapsed, in step S19, the heat-source-side control device 201 resets the timer, and instructs the relay-unit control device 203 to perform the process of step S20. In step S20, the relay-unit control device 203 determines, on the basis of the detection signal from the drain sensor 17, whether dew-condensation water is collected in the drain pan 20 or not. When it is determined that dew-condensation water is collected in the drain pan 20, the step to be carried out returns to step S19. When it is determined that dew-condensation water is not collected in the drain pan 20, the step to be carried out proceeds to step S21.

In step S21, the heat-source-side control device 201 determines whether or not to end the control of the treatment of dew-condensation water. When it determines to end the control of the treatment of dew-condensation water, the treatment of dew-condensation water is ended. Ending the treatment means stopping of supplying of electric power to the heater 15, or reduction of the operation frequency of the compressor 1 to the original value. When the heat-source-side control device 201 determines not to end the control of the treatment of dew-condensation water, it returns to step S11, and repeatedly executes the processes from step S11 to step S21 at intervals of predetermined time tx2.

The air-conditioning apparatus 100 according to embodiment 1 includes, in the relay unit 53, the gas-liquid separator 8 which separates refrigerant supplied from the heat-source-side unit 51, the liquid-refrigerant supply pipe 111 connected to the gas-liquid separator 8 and the load-side expansion devices 6*a* and 6*b*, the drain pan 20 which receives dew-condensation water generated in the relay unit 53, and the heat transfer body which is provided in the drain pan 20 and is in contact with the liquid-refrigerant supply pipe 111.

According to embodiment 1, during the cooling only operation and the cooling main operation of the load-side units 52*a* and 52*b*, the temperature of the liquid-refrigerant supply pipe 111 is raised to a high value, and heat of the liquid-refrigerant supply pipe 111 is transferred to dew-condensation water collected in the drain pan 20 via a heat transfer body, thereby evaporating the dew-condensation water. Thus, in the relay unit 53, a drain discharge port does not need to be provided. Nor does a drain hose need to be provided. Therefore, time and cost are saved, since it is unnecessary to install a drain discharge port and a drain hose. Moreover, when dew-condensation water is generated, heat of the liquid-refrigerant supply pipe 111 can be used in evaporation of the dew-condensation water. Therefore, the evaporation can be promoted without consuming further electric power in addition to electric power required in a normal air-conditioning operation.

In embodiment 1, the drain sensor 17 which detects water in the drain pan 20, the temperature sensor which detects the condensing temperature, the heater 15 and the controller 220 which controls the compressor 1 and the heater 15 may be provided.

The controller 220 may increase the operation frequency of the compressor 1 by a set frequency when the drain sensor 17 detects water, and start supplying of electric power to the heater 15 when the drain sensor 17 still detects water even after the elapse of a predetermined time. If heat of the liquid-refrigerant supply pipe 111 is insufficient to cause evaporation of the dew-condensation water generated in the relay unit 53, the operation frequency of the compressor 1 is increased to raise the temperature of refrigerant flowing through the liquid-refrigerant supply pipe 111. As a result, evaporation of dew-condensation water can be promoted. However, if dew-condensation water still remains in the drain pan 20, supplying of electric power to the heater 15 is started. In the case where dew-condensation water is generated, control using heat of the liquid-refrigerant supply pipe 111 is performed prior to usage of the heater 15, whereby the dew-condensation water treatment can be performed while reducing energy consumption, and also reducing the frequency of use of the heater 15.

In embodiment 1, supplying of electric power to the heater 15 may be stopped when the drain sensor 17 comes not to detect water after starting supplying of electric power to the heater 15. In this case, unnecessary power consumption can be prevented.

In embodiment 1, the float switch 18 which detects whether the water level of water collected in the drain pan 20 has reached a predetermined upper limit or not may be provided, and the operation of the compressor 1 may be stopped when the float switch 18 detects that the water level of the drain pan 20 has reached the upper limit. Since the float switch 18 which detects the water level of dew-condensation water is provided in the relay unit 53, the air-conditioning apparatus 100 is stopped even when the heater 15 or the like fails and the water level of dew-condensation water increases. It is therefore possible to provide a system having high reliability, which prevents dew-condensation water from leaking from the relay unit 53 to the outside.

In embodiment 1, the bypass pipe 110, which corresponds to a liquid-refrigerant return pipe branched off from the liquid-refrigerant supply pipe 111 and connected to the first gas pipe 103, may be provided in the relay unit 53. In this case, even if dew-condensation water is generated on a surface of the bypass pipe 110, the dew-condensation water can be evaporated.

In embodiment 1, the lower end of the heat-transfer metal plate 19 and the lower surface of the heat transfer pipe 22 are located at lower levels than the drain sensor 17. Therefore, when dew-condensation water starts to collect in the drain pan 20, the drain sensor 17 detects the dew-condensation water after the water comes into contact with the heat-transfer metal plate 19 and the heat transfer pipe 22. As a result, when dew-condensation water is actually being generated, electric power is supplied to the heater 15 and the operation frequency of the compressor 1 is increased. Therefore, power consumption is not unnecessarily increased when no dew-condensation water is generated.

In the air-conditioning apparatus according to embodiment 1, since the temperature sensor 16 detects the temperature of the heater 15, it is possible to prevent abnormal heating by the heater 15. Thus, the system ensures high safety.

In the air-conditioning apparatus according to embodiment 1, the heat-source-side control device 201 of the heat-source-side unit 51 controls the entire operation of the air-conditioning apparatus 100.

Reference Signs List

| | |
|---|---|
| 1 | compressor |
| 2 | heat-source-side heat exchanger |
| 3 | four-way valve |
| 4 | accumulator |
| 5a, 5b | load-side heat exchanger |
| 6a, 6b | load-side expansion device |
| 7a-7d | check valve |
| 8 | gas/liquid separator |
| 9a, 9b | first opening/closing valve |
| 10a, 10b | second opening/closing valve |
| 11 | first relay-unit expansion device |
| 12 | second relay-unit expansion device |
| 13 | first relay-unit heat exchanger |
| 14 | second relay-unit heat exchanger |
| 15 | heater |
| 16 | temperature sensor |
| 17 | drain sensor |
| 18 | float switch |
| 19 | heat-transfer metal plate |
| 20 | drain pan |
| 21 | pipe |
| 22 | heat transfer pipe |
| 31 | first pressure sensor |
| 32 | second pressure sensor |
| 33a, 33b | first temperature sensor |
| 34a, 34b | second temperature sensor |
| 51 | heat-source-side unit |
| 52a, 52b | load-side unit |
| 53 | relay unit |
| 54 | refrigerant-flow control unit |

-continued

| Reference Signs List | |
|---|---|
| 55a | indoor trifurcated section |
| 55b | relay-unit trifurcated section |
| 100 | air-conditioning apparatus |
| 101 | low-pressure pipe |
| 102 | pipe |
| 103 | first gas pipe |
| 104 | first liquid pipe |
| 105a, 105b | second liquid pipe |
| 106a, 106b | second gas pipe |
| 110 | bypass pipe |
| 111 | liquid-refrigerant supply pipe |
| 112 | gas-refrigerant supply pipe |
| 113 | refrigerant return pipe |
| 130-133 | connection pipe |
| 150a-150d | connection portion |
| 201 | heat-source-side control device |
| 202a, 202b | load-side control device |
| 203 | relay-unit control device |
| 211 | refrigerating-cycle control unit |
| 212 | timer |
| 220 | control unit |
| 231 | CPU |
| 232 | storage unit |
| 233 | heater control unit |
| 234 | refrigerating-cycle support unit |

The invention claimed is:

1. An air-conditioning apparatus comprising:

a heat-source-side unit including a heat-source-side heat exchanger and a compressor;

a plurality of load-side units including respective load-side heat exchangers and respective load-side expansion devices;

a relay unit connected between the heat-source-side unit and the plurality of load-side units by a first gas pipe and a first liquid pipe; and a controller configured to control the compressor, wherein the relay unit includes a gas/liquid separator configured to separate refrigerant supplied from the heat-source-side unit into gas refrigerant and liquid refrigerant, a gas-refrigerant supply pipe and a liquid-refrigerant supply pipe which are connected to the gas/liquid separator and each of the plurality of load-side units, a drain pan provided in a housing of the relay unit, and configured to receive dew-condensation water, a heat transfer body provided in the drain pan and located in contact with the liquid-refrigerant supply pipe, and a drain sensor provided at the drain pan and configured to detect water in the drain pan, and wherein the controller is configured to increase an operation frequency of the compressor by a set frequency in response to the drain sensor detecting water.

2. The air-conditioning apparatus of claim 1, further comprising:

a temperature sensor provided at the heat-source-side heat exchanger, or a pressure sensor provided at the compressor; and a heater provided in the drain pan, wherein the controller is configured to:

measure time from a time at which a condensing temperature of the heat-source-side heat exchanger has reached a target condensing temperature, the condensing temperature being detected by the temperature sensor or found from a saturation temperature determined from a pressure detected by the pressure sensor, and start supplying of electric power to the heater in a case where the drain sensor detects water when the time measured by the timer has reached a predetermined time.

3. The air-conditioning apparatus of claim 2, wherein the controller is configured to stop supplying of electric power to the heater when the drain sensor comes not to detect water.

4. The air-conditioning apparatus of claim 1, further comprising a float switch provided at the drain pan and configured to detect whether a water level of water collected in the drain pan has reached a predetermined upper limit or not, wherein the controller is configured to stop operation of the compressor when the float switch detects that the water level has reached the upper limit.

5. The air-conditioning apparatus of claim 1, wherein the relay unit further includes a liquid-refrigerant return pipe which branches off from the liquid-refrigerant supply pipe, and which is connected to the first gas pipe, the gas-refrigerant supply pipe is connected to the gas/liquid separator and each of the plurality of load side heat exchangers, and the liquid-refrigerant supply pipe is connected to the gas/liquid separator and each of the plurality of load-side expansion devices.

* * * * *